United States Patent [19]

Barton

[11] Patent Number: 5,023,765

[45] Date of Patent: Jun. 11, 1991

[54] PIVOTABLE LAMP BRACKET FOR LINEAR LIGHTING FIXTURE

[76] Inventor: Daniel W. Barton, 17170 Courtney La., Hungtington Beach, Calif. 92649

[21] Appl. No.: 621,576

[22] Filed: Dec. 3, 1990

[51] Int. Cl.[5] ..... F21V 21/10

[52] U.S. Cl. ..... 362/429; 362/287

[58] Field of Search ..... 362/220, 226, 285, 287, 362/427, 429

[56] References Cited

U.S. PATENT DOCUMENTS 4,258,413 3/1981 Mausser ..... 362/287

4,758,548 5/1988 Barton ..... 362/249

4,881,156 11/1989 Shemitz et al. ..... 362/220

*Primary Examiner*—Stephen F. Husar

*Attorney, Agent, or Firm*—Monty Koslover Assoc.

[57] ABSTRACT

A lamp bracket for use in a linear lighting fixture. The lamp bracket is constructed so that when the bracket is attached to the fixture, the lamp socket portion can be pivoted downwards or outwards away from the fixture, permitting easy removal and replacement of the lamp. The invention is an improvement on the previous lamp bracket for the linear lighting fixture, which was fixed horizontally, allowing little room for lamp replacement.

4 Claims, 2 Drawing Sheets

Fig. 1.
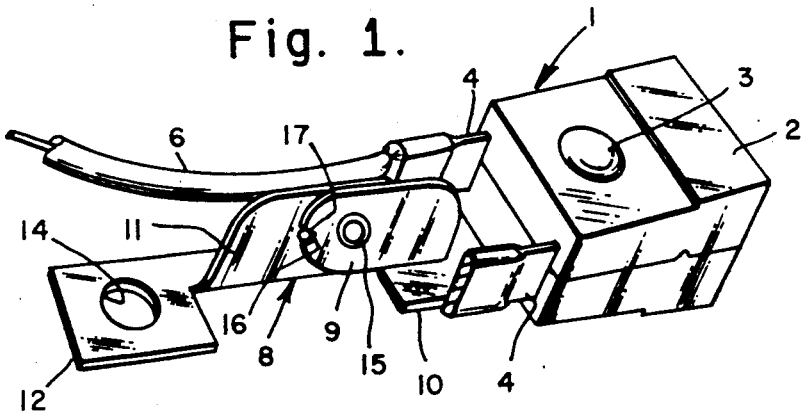
Fig. 2.
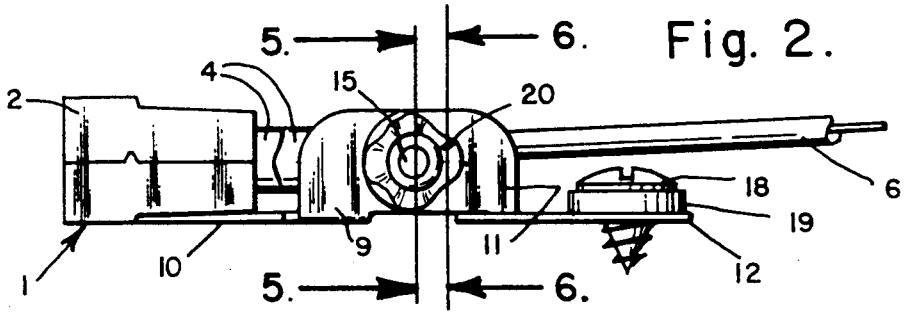
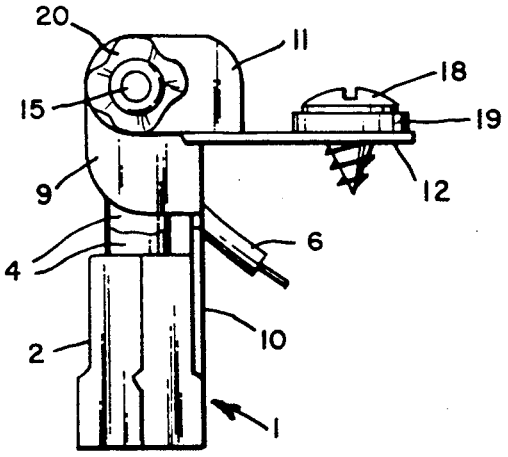
Fig. 3.
Fig. 4.
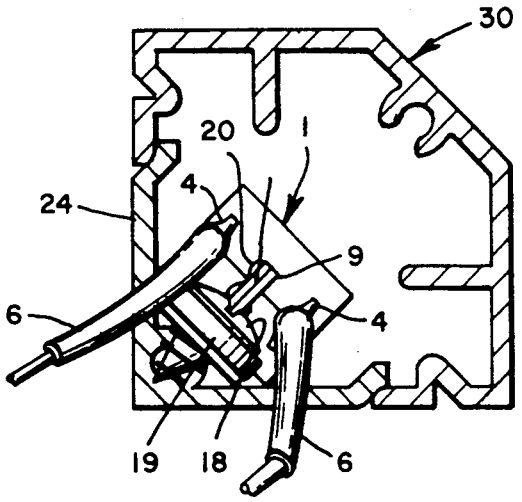

Fig. 5.
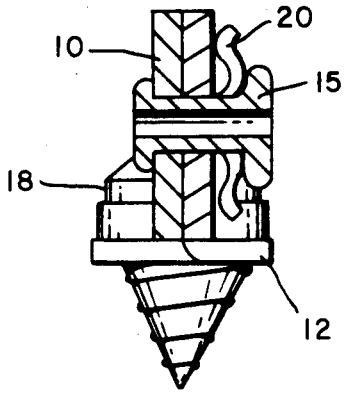
Fig. 6.
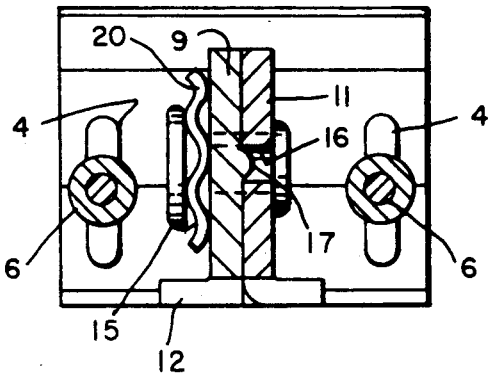
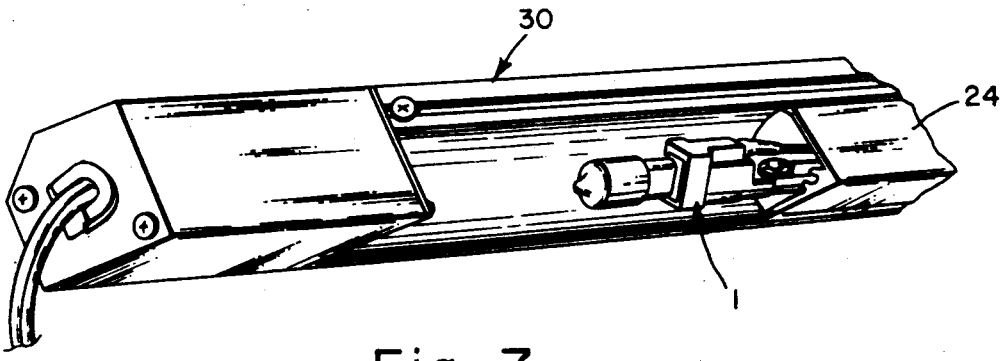
Fig. 7.
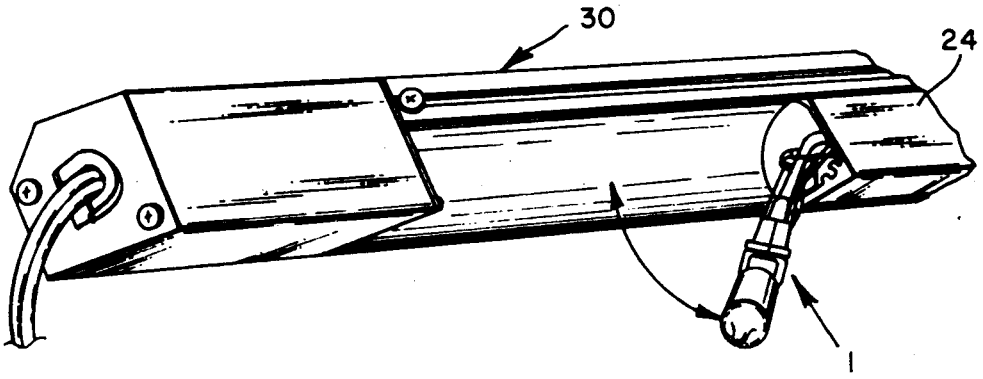
Fig. 8.

PIVOTABLE LAMP BRACKET FOR LINEAR LIGHTING FIXTURE

BACKGROUND AND SUMMARY OF THE INVENTION

This invention relates to a linear lighting fixture and more particularly to an improved lamp bracket for the lighting fixture.

The lighting fixture under consideration is described in U.S. Pat. No. 4,748,548, entitled Lighting Fixture, by Daniel W. Barton. The patent discloses a linear lighting fixture which is adapted for use with low voltage halogen lamps, comprising a substantially U-shaped cross-section member having a pair of longitudinal ridges near the extremities and a plurality of identical light modules capable of being inserted at different locations along the housing. In each light module, there is located a lamp bracket and socket for holding a low voltage halogen lamp. The lamp bracket and socket are accessed by removal of a lens which covers a portion of the light module. However, it has been found that removal and replacement of any lamp is difficult because of the lamp socket being fixedly located in the module, parallel to its walls and in close quarters to the inside surfaces. This allows little space for the average human fingers to grasp the lamp and socket for removal of the lamp. Furthermore, it has been found desirable to be able to tilt the lamp socket at an angle from its present mounting, to use it as a spotlight in some locations. This can not be done with the present lamp-socket mounting.

The present invention is thus an improvement to the linear lighting fixture described in U.S. Pat. No. 4,748,548 in that the lamp bracket has been changed to permit tilting the lamp socket perpendicular to the horizontal. This position allows both easy removal and replacement of the lamp, and also its positioning as a spotlight. The pivotable lamp bracket is designed to be in two parts: one part is fastened by a screw to the fixture and the other part holds the lamp socket. Both parts are joined by a rivet and spring washer which acts as a pivot. Means are provided to hold the lamp socket in either the horizontal or vertical positions.

Accordingly, it is an object of the present invention to imrove the ability of removing and replacing lamps.

Another object is to permit placing the lamps at varying angles to the horizontal plane of the lighting fixture.

Further objects and advantages of the present invention will become apparent from the study of the following portion of the specification, the claims and the attached drawings.

BRIEF DESCRIPTION OF THE DRAWINGS

FIG. 1 is a perspective view of the improved lamp bracket constructed according to the present invention, for use in a linear lighting fixture;

FIG. 2 is a side elevation view of the present invention, showing the lamp socket portion in the horizontal position;

FIG. 3 is a side elevation view of the lamp bracket, showing the lamp socket portion pivoted in the vertical position;

FIG. 4 is a cross-sectional view of a light module of the linear lighting fixture, particularly showing the means of fastening the lamp bracket to the fixture;

FIG. 5 is a cross-sectional view taken along lines 5—5 of FIG. 2;

FIG. 6 is a cross-sectional view taken along lines 6—6 of FIG. 2;

FIG. 7 is a partial view of the linear lighting fixture, particularly showing one light module with the lens removed and the lamp bracket of this invention in normal position; and FIG. 8 is a partial view of the linear lighting fixture, particularly showing the lamp bracket of this invention with lamp socket pivoted downwards for removal of the lamp.

BRIEF DESCRIPTION OF THE PREFERRED EMBODIMENT

Referring particularly to the drawings, there are shown in FIGS. 1 and 2 a perspective view and a side elevation view of a lamp bracket 1 constructed according to the principles of this invention. The bracket 1 is designed to be fastened in a light module which is part of a linear lighting fixture. This linear lighting fixture and the light modules to which the lamp bracket 1 is attached, are disclosed in U.S. Pat. No. 4,748,548 "Lighting Fixture" which is incorporated herein by reference thereto.

The lamp bracket 1 comprises a socket 2 having two terminals 4, a bracket support member 8, a socket support member 10, and a pivot means which is used to join the two support members 8, 10 together, allowing rotation of the support members with respect to each other. The pivot means comprises a first rivet 15 and spring washer 20.

The bracket support 8 is made of a rigid material, and is formed into two plane surfaces, so that its forward plane 11 is at an angle of approximately 90 degrees to its rear plane surface 12. A first hole 14 for seating the bracket fastening screw 18 and washer 19, is located in the rear plane surface 12 of the bracket support member 8.

The socket support member 10 is similarly made of a rigid material and formed into two plane surfaces, so that its rear plane surface 9 is at an angle of approximately 90 degrees to its forward plane surface. The socket 2 is fastened conventionally to the socket support member 10 forward plane surface by a second rivet 3. Electrical lead wires 6 are connected to each of the socket terminals 4.

As shown in FIGS. 1 and 2, the forward plane 11 of the bracket support member 8 and the rear plane 9 of the socket support member 10 are placed together in line, their ends overlapped and joined by insertion of a first rivet 15 and spring washer 20 through both members. As assembled in FIG. 1, the pivot means of rivet 15 and spring washer 20 permit the socket support member 10 to be pivoted around the bracket support member 8, which will be fixed in plane in the linear lighting fixture. Although, the socket support 10 could be pivoted up or down in the lamp bracket 1, when attached to the light module of the linear lighting fixture, it will necessarily be constrained by space to pivot only downwards. This vertical position is illustrated in FIG. 3.

Referring now to FIG. 4, it is seen that the lamp bracket 1 is fastened by a screw 18 into a seat 26 in the corner of the light module housing 24. The light module housing 24 is shown in cross-section for the sake of clarity. In this position, the lamp bracket 1 will be parallel with the horizontal plane of the light module 24 and located as described in the prior patent.

In order to keep the socket support 10 normally in line with the bracket support 8 and horizontal in the lighting fixture, a notch 16 is formed in the end of the rear portion 9 of the socket support. This notch 16 matches a small projection 17, which is raised in the surface of the bracket support member 8 near the end of its forward plane 11, and located lined up with the notch 16 when both members 8 and 10 have their are horizontally aligned. The action of the spring washer 20, pushing against the overlapping ends of the bracket and socket supports, holds the lamp socket end rotated at any desired angle, be it vertical or 45 degrees, preventing unintentional and inadvertent rotation.

The action of the spring washer 20 against the rivet 15, which acts as a pivot, and the notch 16 and small projection 17, are illustrated in the FIG. 5 and FIG. 6 cross-section views of the device.

Referring now to FIGS. 7 and 8, there are shown two views of the improved lamp bracket 1 location in the light module 24 of the linear lighting fixture 30. In FIG. 7, it is clear that it would be difficult to remove the halogen lamp while the lamp bracket is in the horizontal position. In FIG. 8, the ease of removing the lamp from the rotated lamp socket is evident. Thus, incorporation of the improved lamp bracket in the light module makes it easy to remove and replace lamps as needed, or simply to adjust the lamp at an angle other than the normal horizontal.

From the foregoing description, it is believed that the preferred embodiment achieves the objects of the present invention. Alternative embodiments and modifications will be apparent to those skilled in the art. These and other alternatives are considered to be equivalent and within the spirit and scope of the present invention.

Having described the invention, what is claimed is:

1. In a linear lighting fixture containing light modules, lamp sockets and supporting brackets adapted for use with low voltage halogen lamps, an improved lamp bracket; said lamp bracket comprising:

a lamp socket;

a socket support member, made of a rigid material and formed into two plane surfaces: a forward plane and a rear plane which are perpendicular to each other; said rear plane being shaped and sized to fit a surface of said lamp socket; said socket support member being connected to said lamp socket by a rivet through said rear plane surface;

a bracket support member, made of a rigid material and formed into two plane surfaces: a forward plane and a rear plane which are perpendicular to each other; and a pivot means which is used to join the forward plane of said bracket support member to the rear plane of said socket support member, allowing said socket support member to be rotated with respect to said bracket support member.

2. A lamp bracket according to claim 1 wherein:

said bracket support member has first hole cut in said rear plane surface; said hole being sized to seat a bracket fastening screw and flat washer; said hole being for the purpose of enabling fastening said lamp bracket to the housing of said light module in said lighting fixture.

3. A lamp bracket according to claim 1 wherein:

said pivot means includes a rivet and a spring washer; said rivet being passed through a hole in the forward plane of said bracket support member and a hole in the rear plane of said socket support member, and having said spring washer interposed so that it bears against said support members with pressure sufficient to prevent loose unintentional rotation of said support members, while permitting deliberate adjustment of position.

4. A lamp bracket according to claim 1 wherein:

said lamp bracket includes means for holding itself horizontally with both support members in line; said means for holding, including a notch cut in the end of the rear plane of said socket support member and a small projection raised in the surface of the forward plane of said bracket support member, located near its end; said notch fitting over said projection when both support members are in line, preventing inadvertent rotational movement.

* * * * *